US008091403B2

(12) United States Patent
Woulds

(10) Patent No.: US 8,091,403 B2
(45) Date of Patent: Jan. 10, 2012

(54) BODYMAKER RAM ATTACHMENT

(75) Inventor: William Woulds, Shipley (GB)

(73) Assignee: Crown Packaging Technology, Inc., Alsip, IL (US)

( * ) Notice: Subject to any disclaimer, the term of this patent is extended or adjusted under 35 U.S.C. 154(b) by 352 days.

(21) Appl. No.: 12/443,351

(22) PCT Filed: Sep. 17, 2007

(86) PCT No.: PCT/EP2007/059782

§ 371 (c)(1),
(2), (4) Date: Mar. 27, 2009

(87) PCT Pub. No.: WO2008/037617

PCT Pub. Date: Apr. 3, 2008

(65) Prior Publication Data

US 2010/0037671 A1 Feb. 18, 2010

(30) Foreign Application Priority Data

Sep. 28, 2006 (EP) ..... 06121395

(51) Int. Cl.
*B21D 37/01* (2006.01)
*B21D 24/16* (2006.01)

(52) U.S. Cl. ..... 72/481.7; 72/345; 72/347; 72/377; 72/479

(58) Field of Classification Search ..... 72/334, 72/336, 343, 345, 347, 349, 351, 377, 404, 72/479, 481.1, 481.7, 481.94
See application file for complete search history.

(56) References Cited

U.S. PATENT DOCUMENTS

| | | | | |
|---|---|---|---|---|
| 3,402,591 | A * | 9/1968 | Maeder | 72/345 |
| 3,855,862 | A * | 12/1974 | Moller | 72/334 |
| 4,248,076 | A * | 2/1981 | Bulso et al. | 72/349 |
| 5,465,601 | A * | 11/1995 | Jowitt et al. | 72/347 |
| 5,802,907 | A * | 9/1998 | Stodd | 72/336 |
| 2008/0041133 | A1 * | 2/2008 | Gombas | 72/452.4 |

FOREIGN PATENT DOCUMENTS

| | | |
|---|---|---|
| EP | 0584789 A1 | 3/1994 |
| GB | 2274417 A | 7/1994 |

* cited by examiner

*Primary Examiner* — David Jones
(74) *Attorney, Agent, or Firm* — Woodcock Washburn LLP

(57) ABSTRACT

A bodymaker ram attachment has a screwed locator (60), which is fastened to a slide block (70) of the bodymaker and can be aligned to the machine. A new ram with an internal thread and location diameter is screwed onto the locator. A clamp ring (65) tightens a locking element (80) so as to fix the ram (50) to the locator (60) when screws (68), which fasten the clamp ring to the locator, are tightened. The advantage of this new attachment is that the ram can be removed quickly by loosening the clamp ring and locking element then unscrewing the ram from the locator. The ram can then be removed and replaced by sliding through the front of the machine without the need for further disassembly.

6 Claims, 4 Drawing Sheets

[Fig. 0001]
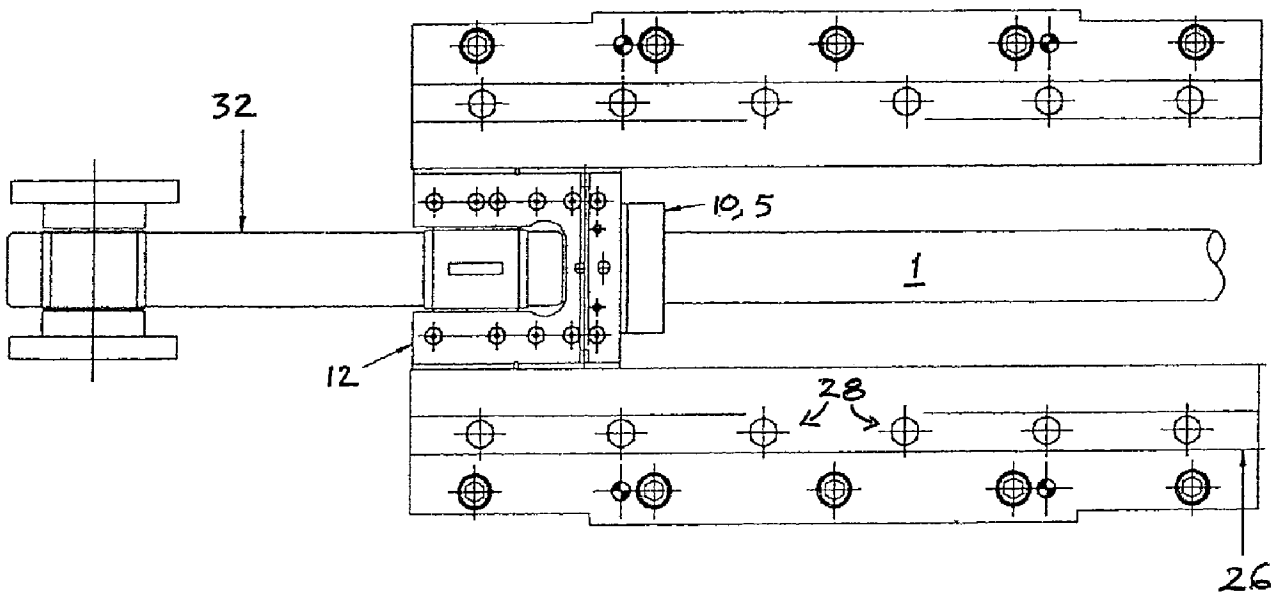

[Fig. 0002]
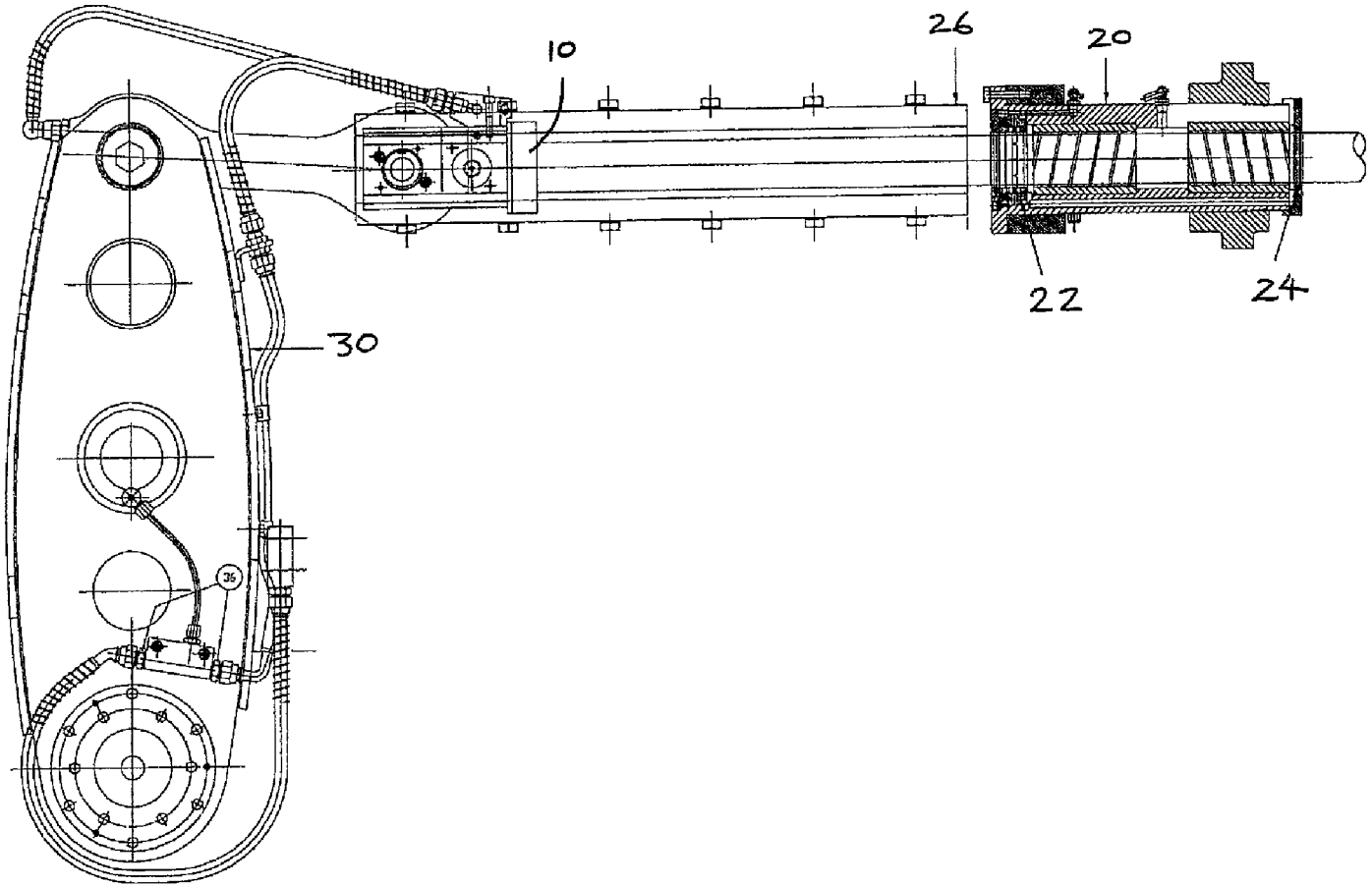

[Fig. 0003]
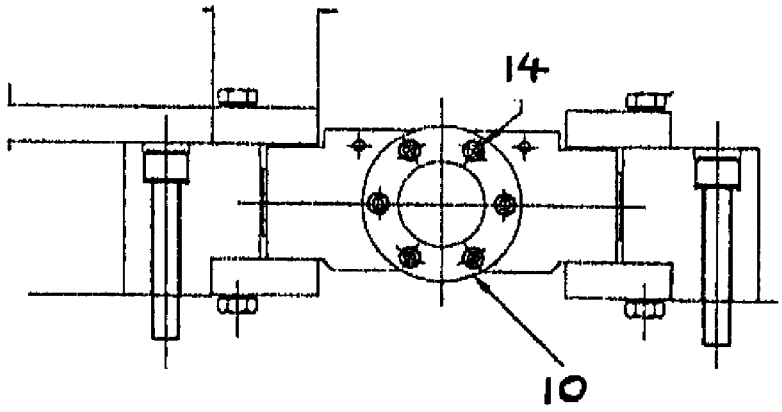

[Fig. 0004]
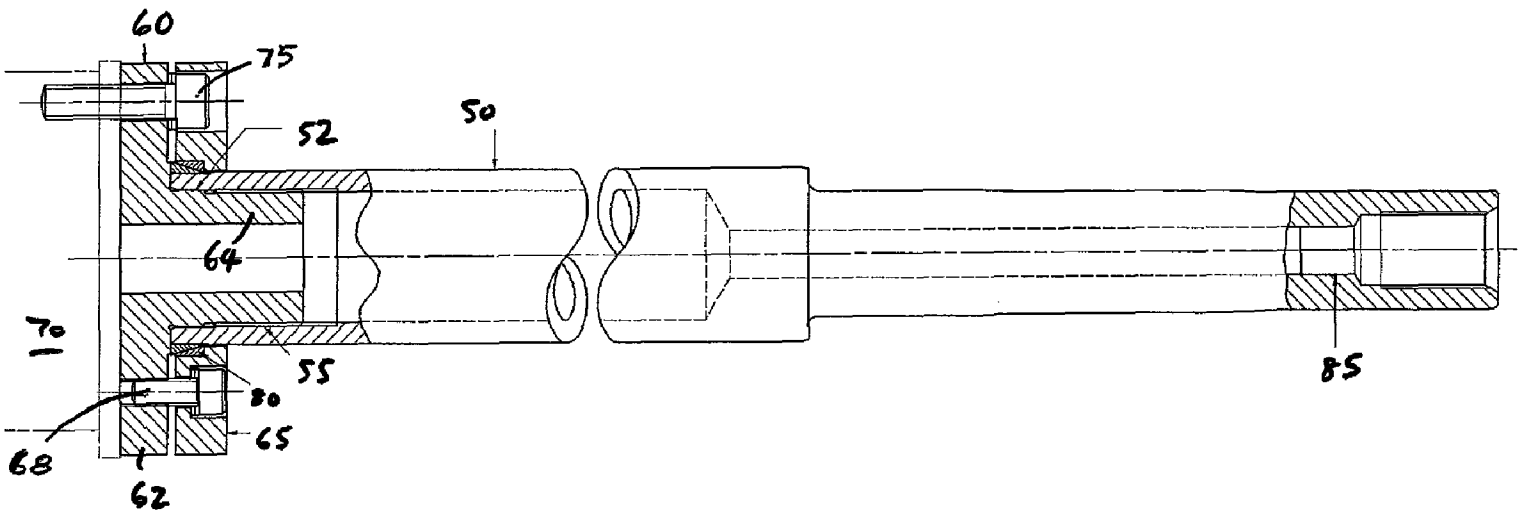

BODYMAKER RAM ATTACHMENT

TECHNICAL FIELD

This invention relates to a bodymaker ram attachment for use in can manufacture. The invention also relates to a method of attaching a bodymaker ram to the bodymaker.

BACKGROUND ART

One example of bodymaker is that used for the production of thin-walled metal cans by the so-called "drawing and wall-ironing" (DWI) process. In a DWI process, a flat circular blank of metal is drawn through one or more drawing dies to form a shallow cup. The cup is then mounted on the free end of a punch which extends from a reciprocating ram, and the cup wall is then "ironed" by passing through one or more ironing dies to lengthen the side wall of the cup and form a can. Clearly it is important to the ironing process that the ram (and punch) are aligned with the bore of the dies if the ironing is to be controlled over repeated cycles.

In order to drive the ram for the reciprocating action, the ram is connected to a slide block of the bodymaker. In known bodymakers, the ram has a flange at one end to allow it to be clamped to the slide block using a clamp ring. This is generally referred to as the "back" end of the ram. The front end of the ram has the punch attached to it. The ram is supported at its opposite (rear) end in a ram guide bush assembly, which includes seals for containing lubricant/hydraulic fluid.

The clamp ring and flange, which secure the ram to the slide block, have a larger diameter than the bore of the bush assembly. Consequently, if the ram needs to be removed, for example to change a set of seals, the ram has to be removed from the rear of the machine. This involves significant "down-time" (several hours) for dismantling the machine to remove the slide block and ram, as well as the time required for subsequent re-alignment of the ram when reassembling. This invention seeks to provide a solution to this problem.

DISCLOSURE OF INVENTION

According to the present invention, there is provided a bodymaker ram attachment, the bodymaker including a slide block and ram, and the ram attachment comprising: a locator having: a cylindrical portion with a connecting feature, and a flange portion for fixing the locator to the slide block; a complementary connecting feature on the ram for connecting the ram to the locator cylindrical portion, a clamp ring adjustably fixed to the locator and adapted to clamp together the ram and the locator when the adjustable connection between the clamp ring and locator is tightened.

Generally the ram attachment further comprises a locking element such that, when the connection between the clamp ring and the locator is tightened, the locking element clamps the ram to the locator. The locking element provides additional clamping force when the clamp ring is tightened.

This locking element prevents the ram from being unscrewed when loosening and tightening the bolt, which secures a punch to the opposite end of the ram.

Furthermore, this arrangement allows the clamp ring and locking element to be loosened or removed from the ram attachment without loosening locator-slide block connection, thereby maintaining alignment of registration diameter on the locator to bushing assembly Preferably, the connecting features are threads, ideally an external thread on the cylindrical part of the locator and an internal thread on the ram. For location register, the ram may include a location diameter. A keyed profile such as a hexagon machined into the opposite end of the ram from the locator may be provided for tightening the connection between the ram and locator.

According to a further aspect of the present invention, there is provided a method of removably fixing a ram to a slide block on a bodymaker, comprising: providing a locator having a flange portion and cylindrical portion, connecting the ram to the cylindrical portion of the locator and the flange portion of the locator to the slide block, adjustably fixing a clamp ring to the locator and thereby clamping the ram and locator together by tightening a locking element.

A preferred embodiment of the invention will now be described, with reference to the drawings, in which:

BRIEF DESCRIPTION OF THE DRAWINGS

FIG. 1 is a top view of a prior art ram attachment for a bodymaker;

FIG. 2 is a side view of the attachment of FIG. 1;

FIG. 3 is a front view of the attachment of FIG. 1; and

FIG. 4 is a side sectional view of a ram attachment according to the present invention.

MODE FOR THE INVENTION

The prior art ram attachment shown in FIGS. 1 to 3 comprises clamp ring 10, which clamps a ram 1 to a slide or slide block 12 using a flange on the back of the ram. Although the flange is referred to by its reference 5, the flange of the prior art is, in fact, enclosed within the clamp ring 10 and cannot be seen when assembled. As shown in FIG. 2, the clamp ring 10 and flange 5 that secure the ram 1 to the slide block have a larger diameter than the bore of the ram bush assembly 20. In order to remove the ram seals (22, 24) the ram has to be removed backwards from the machine. The procedure used to achieve a change of the seals is outlined below.

Referring firstly to FIG. 2, the machine has to be positioned with the ram fully back (bottom dead centre) and the oil turned off. Once the oil has been turned off, the machine cannot be moved. The top slide plates 26 are then removed by removing the 12 off screws 28 then lifting the plates 26 from the machine. The 6 off ram clamp ring screws 14 (FIG. 3) are then removed and the ram 1 moved forward to clear the slide block 12.

For the shorter stroke machines the slide block 12 (which is sometimes referred to as a yoke slide) can then be lifted upwards by pivoting it around a pin on the top of swing lever 30 (FIG. 2). The slide 12 (FIG. 1) has to be supported in a position high enough for the ram 1 to pass below it. This requires two people either to hold the slide up or to place a support under it (i.e. block of wood). The ram can then be pulled backwards out of the bush assembly 20 under the supported slide, lifted upwards and taken out of the rear of the machine.

On the long stroke machines the end of the ram hits the secondary connecting rod ("conn-rod") 32 (see FIG. 1) before it clears the bush assembly 20. In this case the slide 12 and conn-rod 32 have to be removed from the machine first. The seals 22, 24 can then be removed and replaced and the machine reassembled in reverse order.

A preferred embodiment of ram attachment is shown in FIG. 4.

In the new ram attachment of the present invention as shown in FIG. 4, the ram 50 is provided with an internal screw thread 55, and a location diameter for screwing onto a locator 60. The locator 60 has an annular flange 62 and a cylindrical part 64. A screw thread on the cylindrical part 64 connects with the complementary internal thread on the ram.

The locator is secured to the slide block 12 by screws/bolts 75 and can therefore be aligned to the machine. A clamp ring 65 is secured to the locator 60 with screws 68 (one shown). As screws 68 are tightened, they clamp the locking element 80 onto the ram, thereby fixing the ram to the locator. The clamp ring and locking element can thus be loosened or removed from the ram attachment without loosening screws 75.

The alignment of the register diameter on the locator to the bushing assembly is thereby maintained since the locator stays in position, even if the ram needs to be removed. The "down-time" associated with known bodymaker ram attachments is significantly reduced since, for example, there is no realignment required after change of seals.

Hexagon 85 machined into the opposite end (right hand in the figure) enables the ram connection to the locator to be tightened further by use of an Allen key.

The significance of locking element 80 is seen by the additional clamping force, which it provides. This prevents rotation of the ram when the clamp ring is tightened. The locking element 80 also prevents the ram from being unscrewed when loosening or tightening the bolt, which secures a punch to the ram.

To remove the ram for changing seals, for example, the clamp ring screws 68 need only be loosened to release the locking element 80. The ram 50 can then be unscrewed from the locator 60 and then removed from the front of the machine simply by sliding it forwards through the bush assembly. Nothing further needs to be removed before replacing of the seals and ram. As there is no further disassembly, machine position is unaffected and time-consuming re-alignment and set-up procedures are not required.

The invention claimed is:

1. A bodymaker ram attachment for a bodymaker that includes a slide block and a ram, the ram attachment comprising:

a locator, having:

a cylindrical portion defining a connecting feature that is adapted to mate with a complementary connecting feature on the ram to thereby connect the locator to the ram, and a flange portion extending from the cylindrical portion, the flange portion adapted to be fixed to the slide block to thereby secure the locator to the slide block; and a clamp ring adapted to be adjustably connected to the locator such that the ram and the locator are clamped together when the adjustable connection between the clamp ring and the locator is tightened.

2. A ram attachment according to claim 1, further comprising a locking element configured such that, when the connection between the clamp ring and the locator is tightened, the locking element clamps the ram to the locator.

3. A ram attachment according to claim 1, wherein the connecting feature on the locator is screw threads.

4. A ram attachment according to claim 3, wherein the threads are an external thread on the cylindrical part of the locator.

5. A bodymaker that is configured to form a can body, the bodymaker comprising:

a ram defining a connecting feature, and a keyed profile; and a ram attachment configured to connect the ram to a slide block, the ram attachment including:

a locator having a cylindrical portion, and a flange portion adapted to be secured to the slide block, the cylindrical portion defining a connecting feature that is adapted to mate with the connecting feature of the ram so as to connect the locator to the ram, wherein the keyed profile of the ram is for tightening the connection between the ram and locator; and a clamp ring adapted to clamp together the ram and the locator.

6. A method of removably fixing a ram to a slide block on a bodymaker, the method comprising the steps of:

providing a locator having a flange portion and a cylindrical portion that defines a connecting feature, mating a complementary connecting feature defined by the ram to the connecting feature defined by the cylindrical portion of the locator, connecting the flange portion of the locator to the slide block, and adjustably fixing a clamp ring to the locator so as to tighten a locking element to thereby clamp the ram and locator together.

* * * * *